US008421722B2

(12) United States Patent
Chen et al.

(10) Patent No.: US 8,421,722 B2
(45) Date of Patent: Apr. 16, 2013

(54) METHOD OF TRANSMITTING DATA FROM TIMING CONTROLLER TO SOURCE DRIVING DEVICE IN LCD

(75) Inventors: Chien-Chung Chen, Tainan County (TW); Po Hsien Tsai, Tainan County (TW)

(73) Assignee: Himax Technologies Limited, Tainan County (TW)

( * ) Notice: Subject to any disclaimer, the term of this patent is extended or adjusted under 35 U.S.C. 154(b) by 1586 days.

(21) Appl. No.: 11/566,647

(22) Filed: Dec. 4, 2006

(65) Prior Publication Data

US 2008/0129713 A1 Jun. 5, 2008

(51) Int. Cl.
*G09G 3/36* (2006.01)

(52) U.S. Cl.
USPC ..... 345/87; 345/88

(58) Field of Classification Search ..... 345/87–104, 345/204
See application file for complete search history.

(56) References Cited

U.S. PATENT DOCUMENTS

| | | | | |
|---|---|---|---|---|
| 7,342,564 | B2 * | 3/2008 | Ham et al. | 345/98 |
| 2001/0030649 | A1 * | 10/2001 | Mamiya et al. | 345/530 |
| 2002/0089484 | A1 * | 7/2002 | Ahn | 345/98 |
| 2003/0058213 | A1 * | 3/2003 | Okada | 345/96 |
| 2004/0085275 | A1 * | 5/2004 | Sugiyama et al. | 345/87 |
| 2004/0233190 | A1 * | 11/2004 | Chow | 345/204 |
| 2005/0062711 | A1 * | 3/2005 | Kobayashi | 345/100 |
| 2006/0202935 | A1 * | 9/2006 | Yi | 345/98 |
| 2006/0262065 | A1 * | 11/2006 | Luo et al. | 345/98 |
| 2007/0063954 | A1 * | 3/2007 | Huang | 345/98 |
| 2007/0120805 | A1 * | 5/2007 | Yi | 345/100 |
| 2007/0182690 | A1 * | 8/2007 | Lin | 345/100 |
| 2007/0211010 | A1 * | 9/2007 | Lin | 345/99 |
| 2007/0216630 | A1 * | 9/2007 | Liao | 345/100 |
| 2007/0229434 | A1 * | 10/2007 | Liao | 345/98 |

FOREIGN PATENT DOCUMENTS

| | | |
|---|---|---|
| TW | 559760 | 11/2003 |
| TW | 200608346 | 3/2006 |

OTHER PUBLICATIONS

Notice of Allowance from Taiwan Patent Office from counterpart Taiwan application 096107112 dated Nov. 1, 2011 which cites TW559760, TW200608346, US20030058213, US20050062711.

* cited by examiner

*Primary Examiner* — Alexander Eisen
*Assistant Examiner* — Nelson Lam
(74) *Attorney, Agent, or Firm* — WPAT, P.C.; Anthony King

(57) ABSTRACT

A method of transmitting data from a timing controller to a source driving device in a liquid crystal display is disclosed. The method of the present invention comprises the steps of: (a) providing a setup/hold time; (b) transmitting a test pattern from the timing controller to the source driving device using the setup/hold time; (c) returning an acknowledge signal from the source driving device to the timing controller when the test pattern is successfully received by the source driving device; (d) providing a new setup/hold time and repeating Steps (b) and (c) using the new setup/hold time when the test pattern is not successfully received by the source driving device; and (e) transmitting the image data from the timing controller to the source driving device using the new setup/hold time upon receipt of the acknowledge signal. Therefore, the use of the setup/hold time adjustment pins is eliminated.

8 Claims, 7 Drawing Sheets

METHOD OF TRANSMITTING DATA FROM TIMING CONTROLLER TO SOURCE DRIVING DEVICE IN LCD

BACKGROUND OF THE INVENTION

1. Field of the Invention

The present invention relates to a method of transmitting data in a liquid crystal display, and more particularly, to a method of transmitting data from a timing controller to a source driving device in a liquid crystal display.

2. Description of the Related Art

In the display industry, the consistent trend is to move toward higher-resolution displays. However, increasing the resolution results in increasing the overall data rate both from the host (e.g., a graphic card) to the panel, and within the panel itself. By the late 1990s, resolutions for LCD (liquid crystal display) panels were moving from VGA (video graphics array) resolutions with a cumulative bandwidth requirement of slightly more than 300 Mbits/sec to XGA (extended graphics array) resolutions that required 850 Mbits/sec. Additionally, UXGA (ultra extended graphics array) resolution and its 2 Gbits/sec requirement loomed on the horizon. The increasing frequency was creating problems with the TTL (transistor-transistor logic) interface between the host and the LCD panel. Power consumption was ballooning, electromagnetic interference (EMI) was on the rise, and larger connectors and cables were required to meet the expanding number of data lines.

In 1999, National Semiconductor Corporation released the Open Low-Voltage Differential-Signaling Display Interface, or OpenLDI specification, which serialized 22 TTL signals down to four differential pairs. Because the new interface was low swing (±400 mV versus several volts for TTL) and differential, the total power and EMI were significantly reduced. Also, as the total number of wires was reduced from 22 down to eight, the connectors and cabling shrank, saving system cost and improving the mechanical connection between the host and the panel.

Once the issues of the host-panel interface were solved, similar issues occurred within the panel. National Semiconductor Corporation utilized the success of Low Voltage Differential Signaling (LVDS) and OpenLDI as a baseline for creating another open standard for the Reduced-Swing Differential-Signaling (RSDS) interface to solve intra-panel interface issues. The RSDS interface reduced the total number of wires from 72 (two 36-wide buses) to 20 (10 differential pairs), and the voltage swings were ±200 mV differential, reducing both the power and the EMI of the panel.

FIG. 1 shows a block diagram of an LCD module, which demonstrates an arrangement of an RSDS bus in the LCD module. The LCD module comprises an LCD panel 1 having plural thin film transistors disposed in a matrix form, a gate driving device 4 having plural gate driving units electrically connected to the gates of the thin film transistor through plural scan lines 41, a source driving device 3 having plural source driving units electrically connected to the sources of the thin film transistors through plural data lines 31, and a timing controller 2 receiving image data through a first bus 5, sending control signals to the gate driving device 4 through a second bus 6, and sending the image data to the source driving device 3 through an RSDS bus 7.

FIG. 2 shows the timing characteristics of a clock signal CLK, a start pulse STH and the image data signal RSR/G/B in accordance with the RSDS standard, where SPSU, SPHD, SPRS, RSSU and RSHD are the start pulse set up time, the start pulse hold time, the start pulse to data valid delay, the RSDS data setup time and the RSDS data hold time, respectively. The start pulse STH sent from the timing controller 2 is two clock cycles (or five clock edges) prior to the start of valid image data. Note that the RSDS standard uses both edges (rising and falling) of the clock to strobe data. In addition, FIG. 3 shows the diagram regarding the RSDS skew-setup/hole time control, due to the open nature of the RSDS standard, the RSSU and RSHD (i.e., setup/hold time) requirements for the start pulse STH and the image data signal RSR/G/B can vary from one channel to another or can vary under different scanning frequency. Therefore to assure the transmission of the image data from the timing controller 2 to the source driving device 3 in all channels, the timing controller 2 should be designed with the capability for setup/hold time adjustment. A conventional method of performing the setup/hold time adjustment is to adjust the skew control pins on a printed circuit board (PCB). The skew control pins can change a voltage swing of the image data for setup/hold time adjustment. Of course, any other kind of setup/hold time adjustment is also acceptable. Once the setup/hold time is set, the skew control pins have to be adjusted manually to meet the requirement of the source driving device 3 due to change of the scanning frequency.

Therefore, it is necessary to develop an automatic mechanism to select a proper setup/hold time so as to transmit the image data from the timing controller 2 to the source driving device 3 successfully.

SUMMARY OF THE INVENTION

The objective of the present invention is to provide a method of transmitting data from a timing controller to a source driving device in an LCD to determine a proper setup/hold time automatically and to eliminate the setup/hold time adjustment pins.

In order to achieve the above objective, the present invention discloses a method of transmitting data from a timing controller to a source driving device. The method of the present invention comprises the steps of: (a) providing a setup/hold time; (b) transmitting a test pattern from the timing controller to the source driving device using the setup/hold time; (c) returning an acknowledge signal from the source driving device to the timing controller when the test pattern is successfully received by the source driving device; (d) providing a new setup/hold time and repeating Steps (b) and (c) using the new setup/hold time when the test pattern is not successfully received by the source driving device; and (e) transmitting the data from the timing controller to the source driving device using the new setup/hold time upon receipt of the acknowledge signal.

BRIEF DESCRIPTION OF THE DRAWINGS

The invention will be described according to the appended drawings in which.

DETAILED DESCRIPTION OF THE INVENTION

Figure 1:
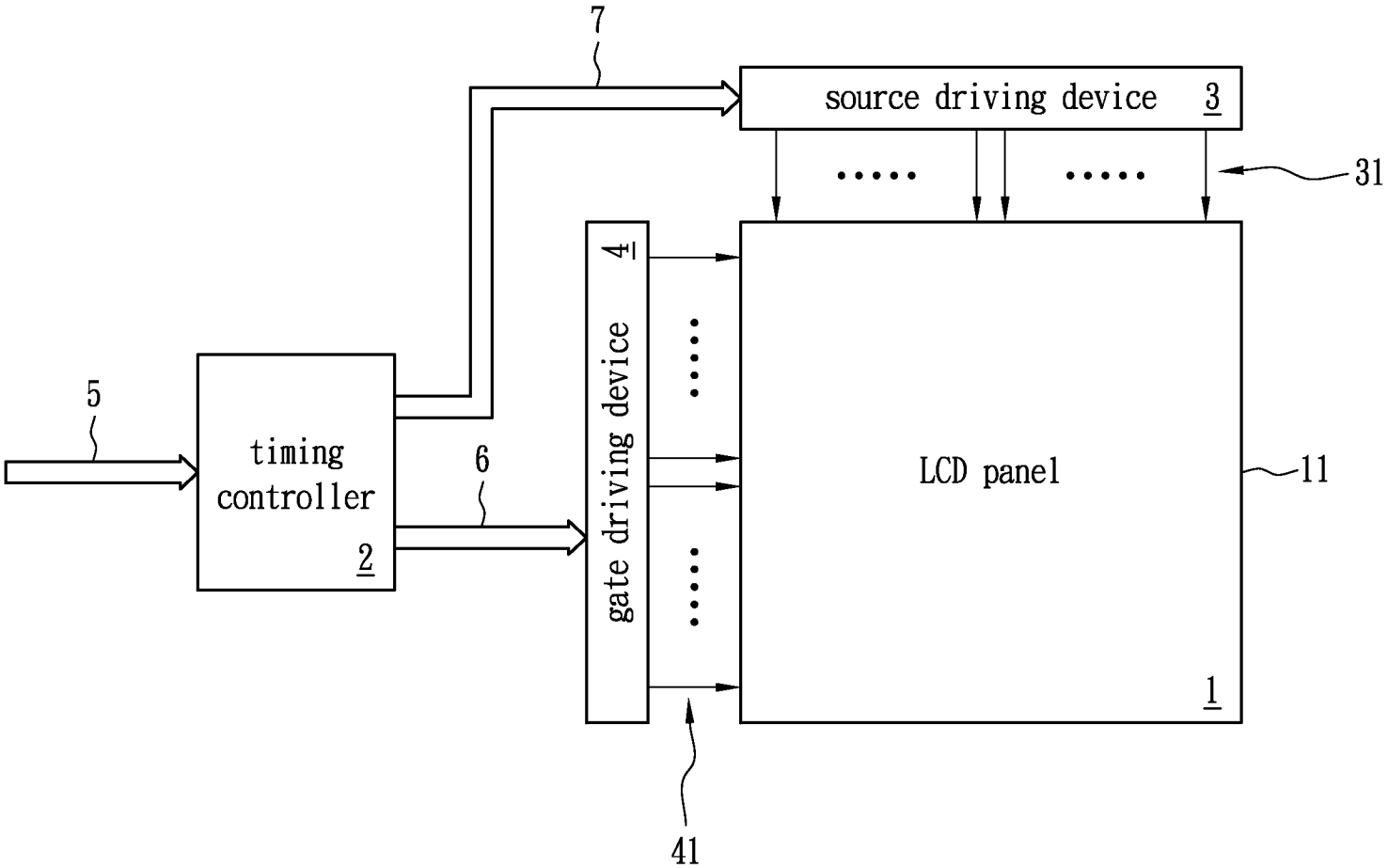
FIG. 1 shows a block diagram of an LCD module.
Figure 4:
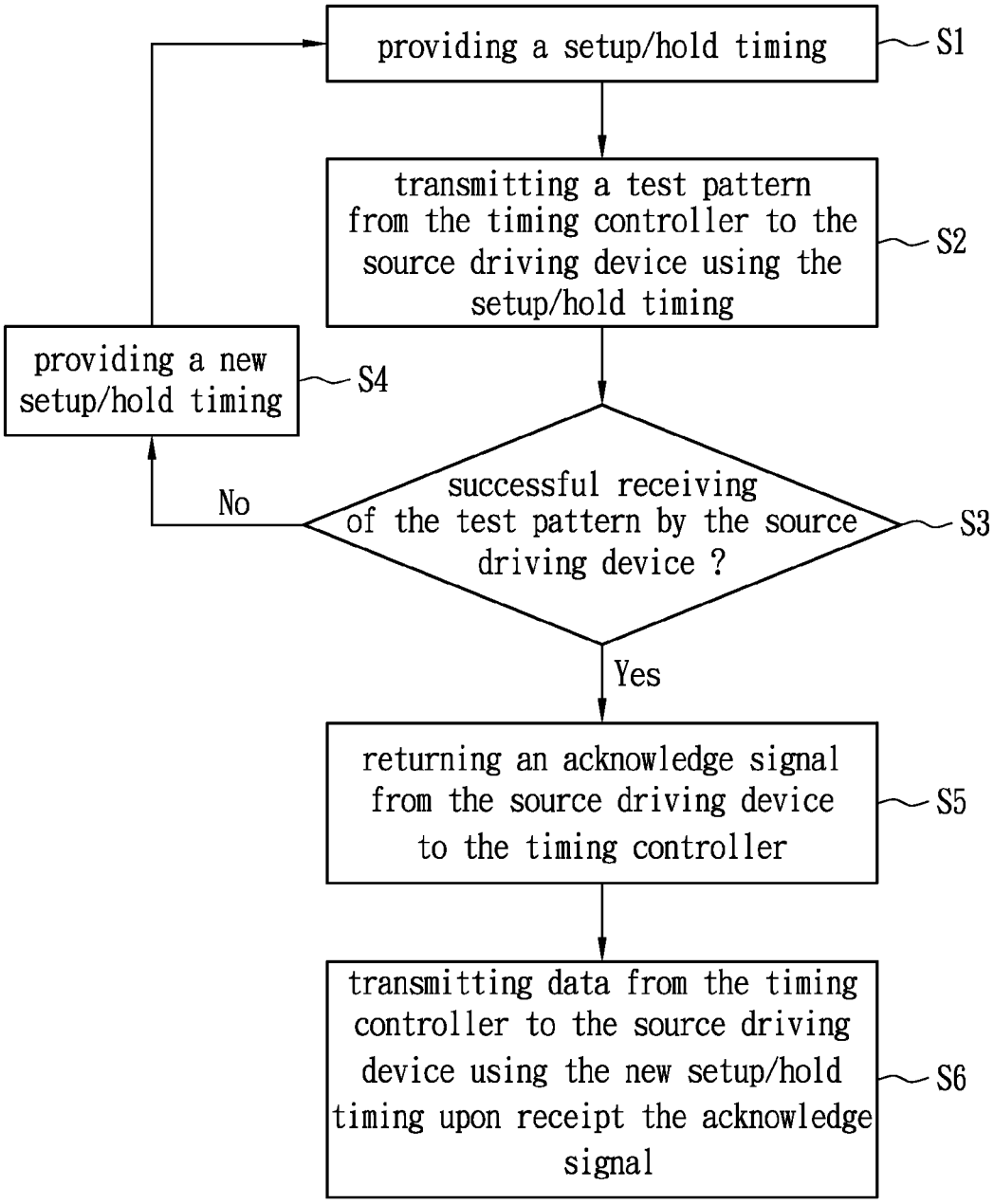
FIG. 4 shows a flow chart of the method of the present invention.
Figure 5:
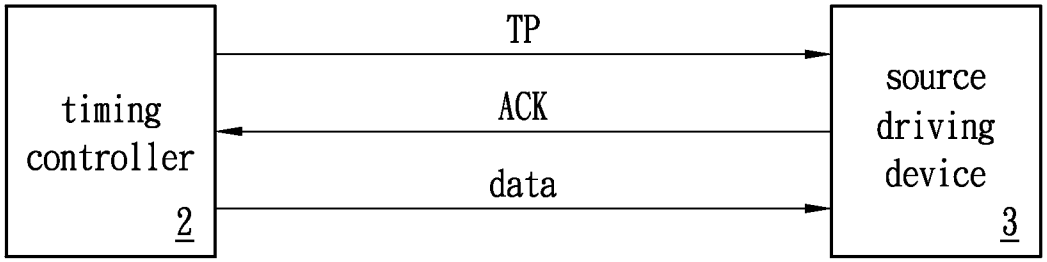
FIG. 5 illustrates signal transmission between the timing controller and the source driving device.

FIG. 4 shows a flow chart of the method of transmitting data from a timing controller to a source driving device in an LCD in accordance with the present invention. FIG. 5 illustrates signal transmission between the timing controller 2 and the source driving device 3, and the details of the method of the present invention are given below. Before image data is sent to the source driving device 3, a setup/hold time is provided by a timing controller 2 (Step S1). Then, a test pattern TP is transmitted from the timing controller 2 to the source driving device 3 using the setup/hold time (Step S2). Next, successful receiving of the test pattern TP by the source driving device 3 is verified (Step S3). If the test pattern TP is not successfully received, a new setup/hold time is provided and Steps S2 and S3 are repeated using the new setup/hold time until the test pattern TP is successfully received (Step S4). If the result of Step S3 is "Yes," the source driving device 3 returns an acknowledge signal ACK to the timing controller 2 (Step S5). After that, the timing controller 2 transmits image data to the source driving device 3 using the new setup/hold time upon receipt of the acknowledge signal ACK (Step S6). The image data and the test pattern TP transmitted from the timing controller 2 to the source driving device 3 are through the RSDS bus 7 (refer to FIG. 1). In this embodiment, the test pattern TP comprises cyclic redundancy codes, the new setup/hold time is provided by changing a voltage swing of the image data, and the acknowledge signal ACK is returned through an additional bus between the timing controller 2 and the source driving device 3.

There could be several test patterns pre-loaded in or calculated by the timing controller 2, and the source driving device 3 stores other patterns corresponding to the test patterns. When a test pattern is transmitted from the timing controller 2 to the source driving device 3, the test pattern is verified with a corresponding pattern in the source driving device 3. A transmission of a test pattern to the source driving device 3 is completed means that the test pattern is transmitted to the source driving device 3 and is verified with the corresponding pattern. Only when the transmission for each source driving unit is completed within a predetermined period of time (i.e., the test pattern is successfully received by the source driving device 3), an acknowledge signal is returned from the source driving device 3 to inform the timing controller 2 that the image data is ready to be sent to the source driving device 3.

Figure 6:
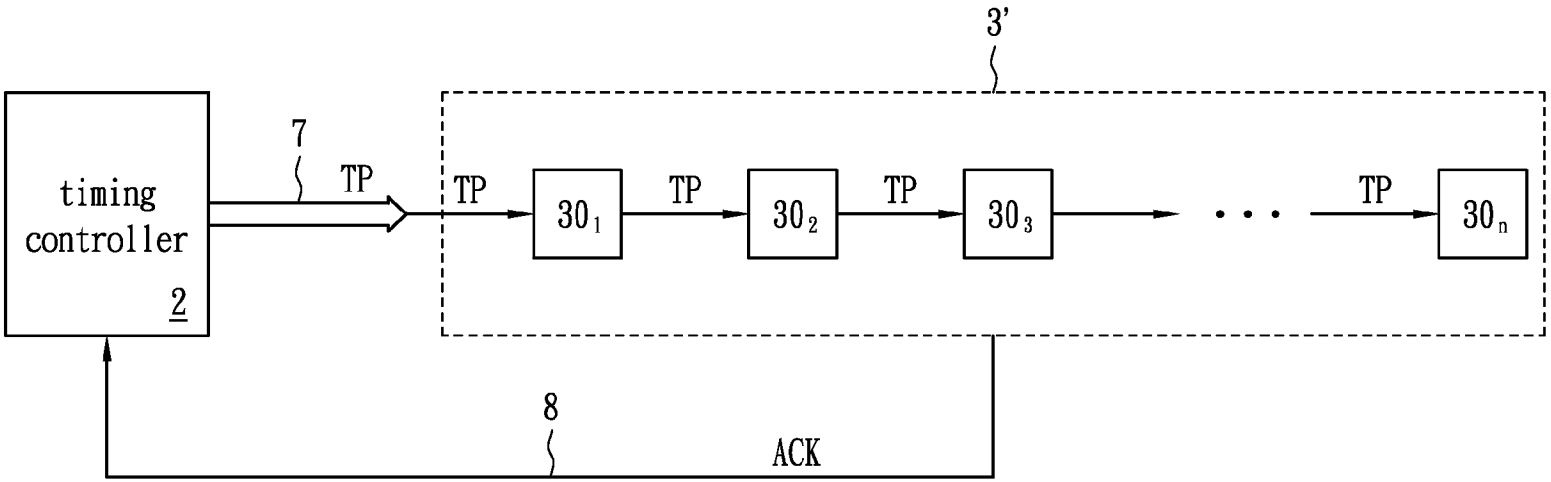
FIG. 6 shows a signal flow according to the first embodiment of the method of the present invention.

FIG. 6 shows a signal flow according to the first embodiment of the method of the present invention. The source driving device 3 comprises a plurality of source driving units $\mathbf{30}_1$-$\mathbf{30}_n$ connected in series. The test pattern TP is transmitted using a setup/hold time provided by the timing controller 2 through the RSDS bus 7 to the source driving device 3'. The first source driving unit $\mathbf{30}_1$ receives and verifies the test pattern TP and then passes it to the second source driving unit $\mathbf{30}_2$. Similarly, each of the following source driving units $\mathbf{30}_3$-$\mathbf{30}_n$ receives and verifies the test pattern TP from the previous source driving unit. That is, when a transmission (including receiving and verifying) of the test pattern TP to a source driving unit $\mathbf{30}_i$ is completed, the next source driving unit $\mathbf{30}_{i+1}$ is activated to receive and verify the test pattern TP. When the transmission of the test pattern TP to the last source driving unit $\mathbf{30}_n$ is completed within a predetermined period of time, the acknowledge signal ACK is returned to the timing controller 2 through an additional bus 8 separated from the RSDS bus 7. If the acknowledge signal ACK is not returned to the timing controller 2 within the predefined period of time, a new setup/hold time is provided by the timing controller 2 (refer to Step S4 of FIG. 4). Then, the test pattern TP is transmitted using the new setup/hold time to the source driving device 3', and Steps S2 and S3 of FIG. 4 are repeated until the acknowledge signal ACK is returned to and received by the timing controller 2. Upon receipt of the acknowledge signal ACK, the timing controller 2 transmits the image data to the source driving device 3' (refer to Step S6 of FIG. 4).

Figure 7:
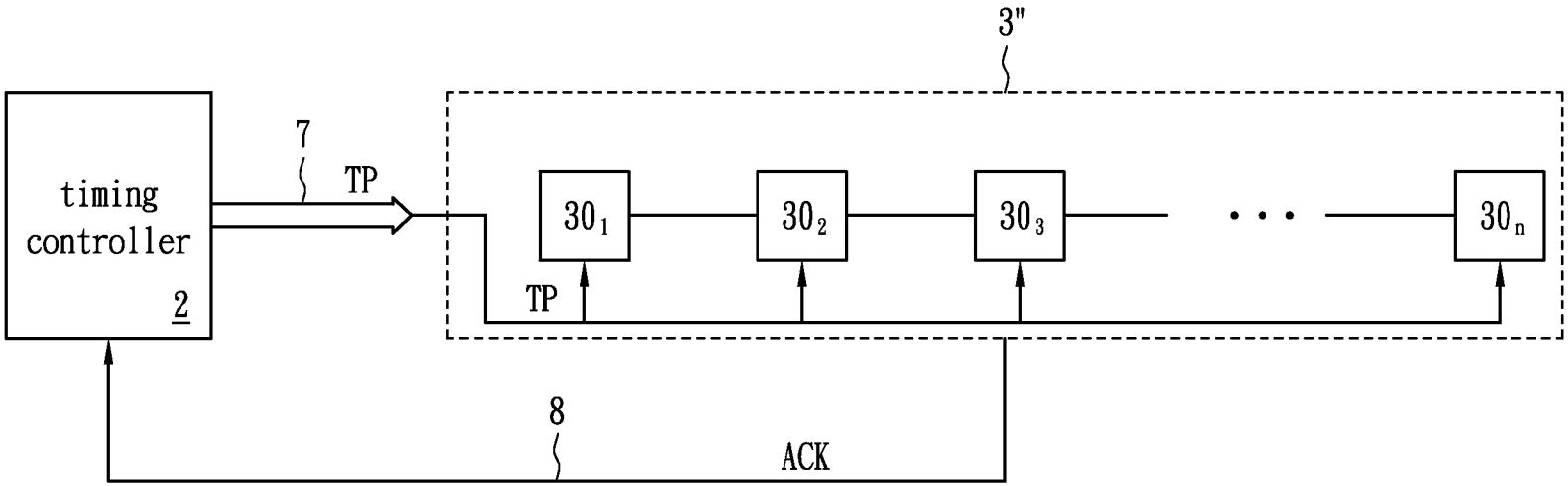
FIG. 7 shows a signal flow according to the second embodiment of the method of the present invention.

FIG. 7 shows a signal flow according to the second embodiment of the method of the present invention. The source driving device 3" comprises a plurality of source driving units $\mathbf{30}_1$-$\mathbf{30}_n$ connected in series. The test pattern TP is transmitted using a setup/hold time provided by the timing controller 2 through the RSDS bus 7 to the source driving device 3" and then to each of the source driving units $\mathbf{30}_1$-$\mathbf{30}_n$. When a transmission (including receiving and verifying) of the test pattern TP to a source driving unit $\mathbf{30}_i$ is completed, the next source driving unit $\mathbf{30}_{i+1}$ is activated to receive and verify the test pattern TP. When the transmission (including receiving and verifying) of the test pattern TP to each source driving unit $\mathbf{30}_i$ is completed within a predetermined period of time, the acknowledge signal ACK is returned to the timing controller 2 through an additional bus 8 separated from the RSDS bus 7. If the acknowledge signal ACK is not returned to the timing controller 2 within the predefined period of time, a new setup/hold time is provided by the timing controller 2 (refer to Step S4 of FIG. 4). Then, the test pattern TP is transmitted using the new setup/hold time to the source driving device 3", and Steps S2 and S3 of FIG. 4 are repeated until the acknowledge signal ACK is returned to and received by the timing controller 2. Upon receipt of the acknowledge signal ACK, the timing controller 2 transmits the image data to the source driving device 3" (refer to Step S6 of FIG. 4).

In another embodiment of the method of the present invention, the acknowledge signal is returned to the timing controller through an existing wire of the RSDS bus, but not through an additional bus separated from the RSDS bus as in the first and the second embodiments.

Figure 2:
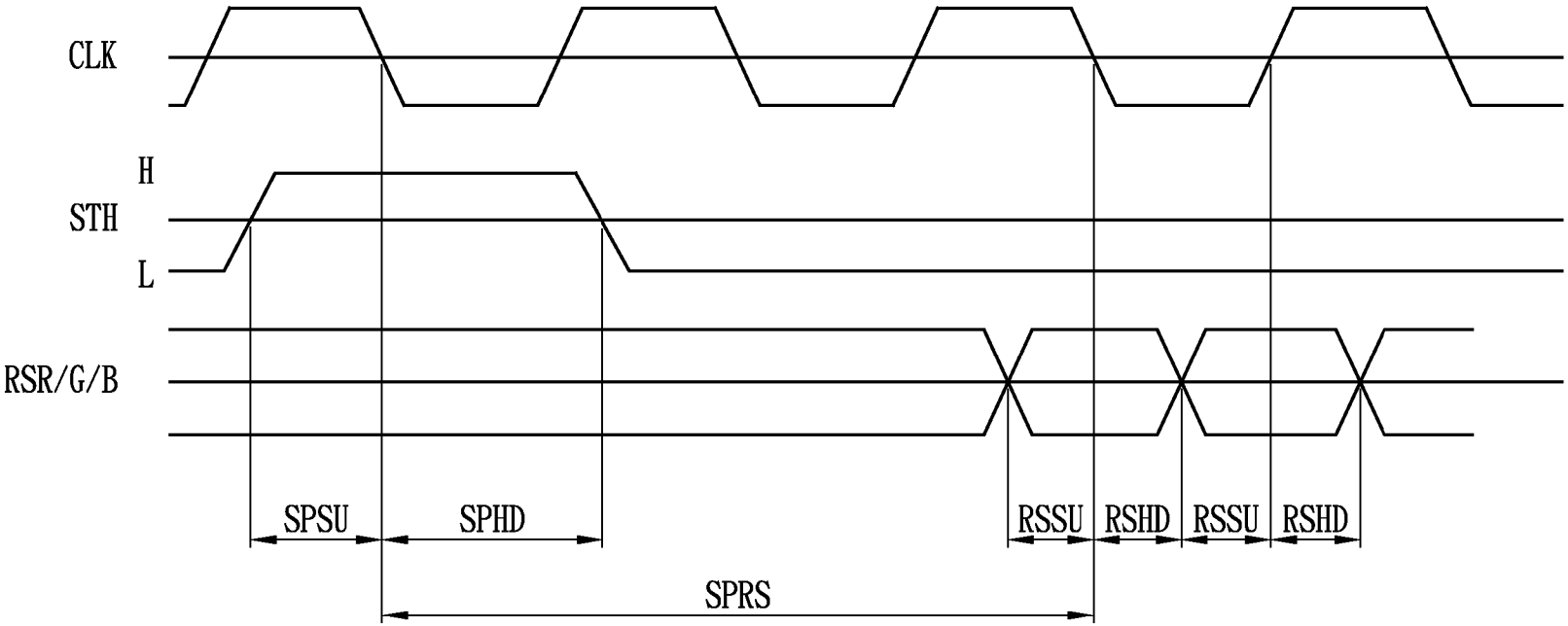
FIG. 2 shows the timing characteristics of some signals in accordance with the RSDS standard.
Figure 3:
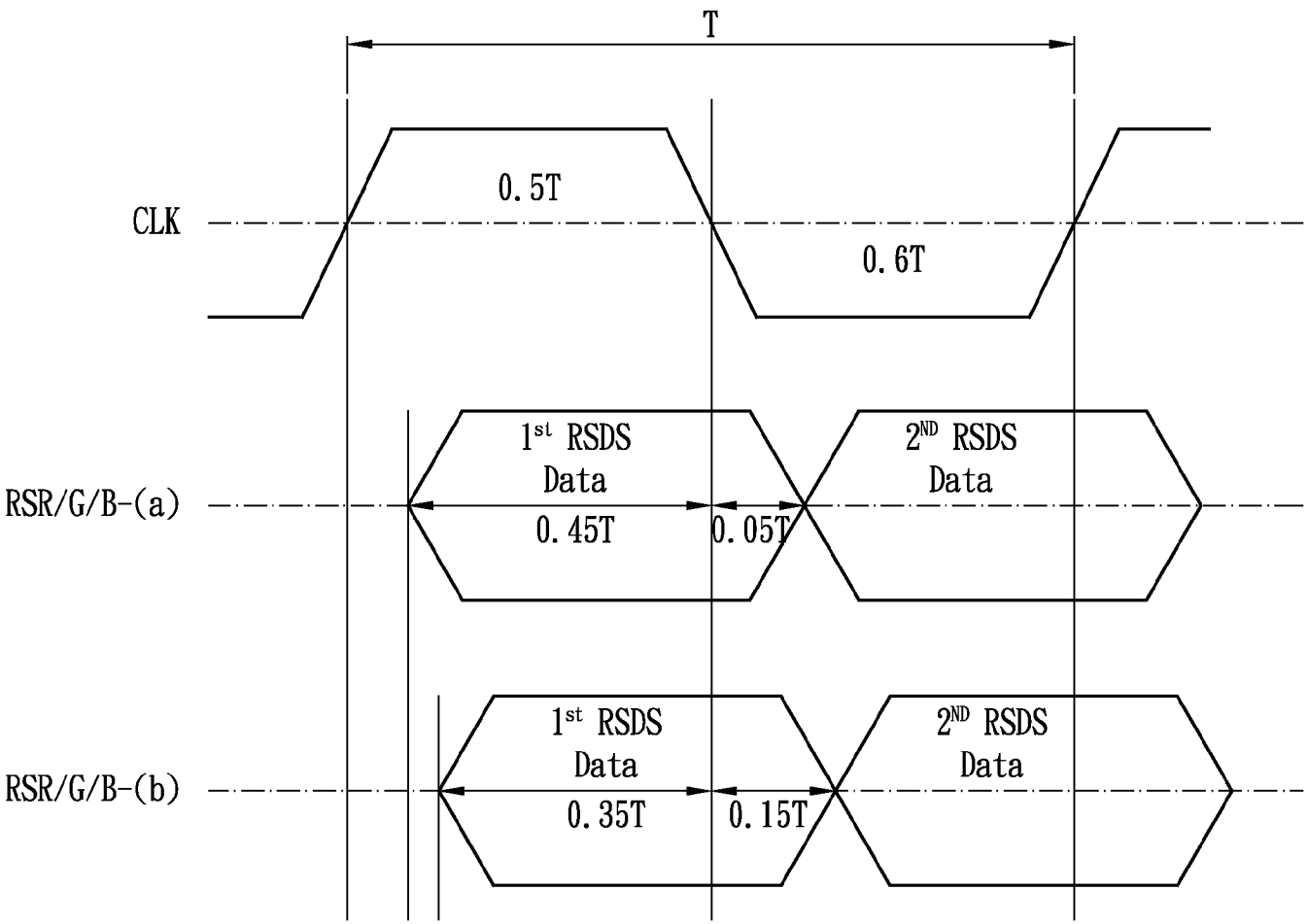
FIG. 3 shows the diagram regarding the RSDS skew-setup/hold time control.

In addition, when the method of the present invention is applied to the RSDS standard, the test pattern TP mentioned in the above embodiments is transmitted to the source driving device upon receipt of the start pulse STH (refer to FIG. 2) issued by the timing controller, and the acknowledge signal is returned when the test pattern TP is successfully received by the source driving device before another start pulse issued by the timing controller is received.

According to the above explanation, the method of transmitting data from a timing controller to a source driving device in an LCD of the present invention exhibits significant advantages of automatically determining a proper setup/hold time and eliminating the setup/hold time adjustment pins required by the prior art.

The above-described embodiments of the present invention are intended to be illustrative only. Numerous alternative embodiments may be devised by those skilled in the art without departing from the scope of the following claims.

What is claimed is:

1. A method of transmitting data from a timing controller to a source driving device in a liquid crystal display, comprising the steps of:

(a) providing a setup/hold time;

(b) transmitting a test pattern from the timing controller to the source driving device using the setup/hold time, wherein the source driving device stores a test pattern corresponding to the transmitted test pattern;

(c) returning an acknowledge signal from the source driving device to the timing controller when the test pattern is successfully received and verified by the source driving device;

(d) providing a new setup/hold time and repeating Steps (b) and (c) using the new setup/hold time until the test pattern is successfully received by the source driving device; and (e) transmitting image data from the timing controller to the source driving device using the new setup/hold time upon receipt of the acknowledge signal, wherein the image data are different from the test pattern.

2. The method of claim 1, wherein the test pattern comprises cyclic redundancy codes.

3. The method of claim 1, wherein the acknowledge signal is returned through an additional bus between the timing controller and the source driving device.

4. The method of claim 1, wherein the step of transmitting data from the timing controller to the source driving device is performed on an RSDS (Reduced Swing Differential Signaling) interface.

5. The method of claim 1, wherein the source driving device comprises a plurality of source driving units connected in series, one activated when a transmission to the previous one is completed, the test pattern is transmitted to each one of the source driving units, and the acknowledge signal is returned only when transmission of the test pattern to each one of the source driving units is completed within a predefined period of time.

6. The method of claim 1, wherein the source driving device comprises a plurality of source driving units connected in series, one activated when a transmission to the previous one is completed, the test pattern is transmitted to the first one of the source driving units, and the acknowledge signal is returned only when transmission of the test pattern to the last one of the source driving units is completed within a predefined period of time.

7. The method of claim 1, wherein the test pattern is transmitted to the source driving device upon receipt of a start pulse issued by the timing controller, and the acknowledge signal is returned when the test pattern is successfully received by the source driving device before receipt of another start pulse issued by the timing controller.

8. The method of claim 1, wherein the new setup/hold time is provided by changing a voltage swing of the data.

* * * * *